US006449987B1

(12) United States Patent
Poole

(10) Patent No.: US 6,449,987 B1
(45) Date of Patent: Sep. 17, 2002

(54) KNITTING AID

(76) Inventor: Deborah Lynn Poole, Box 30583, Calgary,Alberta (CA), T2H 2W2

( * ) Notice: Subject to any disclaimer, the term of this patent is extended or adjusted under 35 U.S.C. 154(b) by 0 days.

(21) Appl. No.: 09/690,719

(22) Filed: Oct. 18, 2000

Related U.S. Application Data

(60) Provisional application No. 60/161,090, filed on Oct. 22, 1999.

(51) Int. Cl.[7] ..... D04B 37/00

(52) U.S. Cl. ..... 66/1 A

(58) Field of Search ..... 66/1 A, 125, 225, 66/117, 118; 206/818, 350, 380

(56) References Cited

U.S. PATENT DOCUMENTS

| | | | | |
|---|---|---|---|---|
| 2,220,633 A | | 11/1940 | Albino | |
| 2,297,806 A | * | 10/1942 | Smith | 206/350 |
| 2,461,816 A | | 2/1949 | Giovanini | |
| 2,580,099 A | * | 12/1951 | Jaeger | 206/350 |
| 3,019,500 A | * | 2/1962 | Duffin et al. | 206/350 |
| 3,054,277 A | * | 9/1962 | Broschard | 206/350 |
| 3,982,631 A | * | 9/1976 | Kunik et al. | 206/350 |
| 4,370,980 A | | 2/1983 | Kroh et al. | |
| 4,866,953 A | | 9/1989 | Slevin | |
| 5,005,380 A | * | 4/1991 | Downey | 206/350 |
| 5,071,004 A | * | 12/1991 | Rivera | 206/350 |
| 5,125,245 A | * | 6/1992 | Kuwabara | 66/1 A |

FOREIGN PATENT DOCUMENTS

| | | |
|---|---|---|
| CA | 411187 | 3/1943 |
| CA | 425037 | 1/1945 |
| DE | 3705513 | 9/1988 |
| GB | 2184461 | 6/1987 |

* cited by examiner

*Primary Examiner*—Danny Worrell
(74) *Attorney, Agent, or Firm*—Miller Thomson LLP

(57) ABSTRACT

A one-handed knitting aid to facilitate hand knitting by persons without the full use of one hand comprises a needle holder with a magnet housing containing a source of a magnetic field, a yarn tensioning device, and an adjustable mounting. The magnet housing has a channel in which a knitting needle may be held by the magnetic field. The mounting may be attached to a convenient object, and may be adjusted so as to tilt or rotate the needle holder.

18 Claims, 3 Drawing Sheets

KNITTING AID

This application claims the benefit of U.S. Provisional Application No. 60/161,090, filed Oct. 22, 1999.

FIELD OF THE INVENTION

The present invention relates to knitting aids, and in particular to knitting aids for use by persons having full use of only one hand.

BACKGROUND TO THE INVENTION

Recreation therapists have been searching for a tool to enable persons with only one functional hand and arm to knit. Most people with two functioning hands are capable of holding a knitting needle in each hand in order to guide the needle tips around each other in the correct motion, while simultaneously holding tension on the yarn and guiding it around the needles in order to make each stitch. However, a person who has lost the use of one hand and arm is able to hold and control only one needle, which under ordinary circumstances makes the knitting process impossible. For example, persons who have suffered a stroke, brain injury, or a shoulder, arm, or hand injury, may be disabled on one side of the body, or may be weak in or unable to use one hand. To do intricate work normally requiring the use of both hands, such persons require a means of gripping a tool or workpiece which substitutes for the hand they are unable to use effectively.

There are a number of knitting aids available for the disabled which are intended to hold the knitting needle from which stitches are being cast off, in a position from which it is easy to work, and from which the needle can be removed without too much difficulty when all the stitches have been cast off. However, in practice none of these known knitting aids effectively meets these two criteria.

One such known knitting aid comprises a block secured to a belt which can be fastened around the user's waist. The block has a hole in it for each size of needle, and in use the needle from which stitches are being cast off is pushed into its respective hole in the block and secured. However, being fastened on the belt around the user's waist, the needle is usually found to be far too close to the body to make knitting comfortable.

Another known knitting aid comprises a clamp which can be tightened onto the needle from which stitches are being cast off. The clamp is provided with means for securing it to the arm of a chair in which the knitter is sitting, and in this position it is usually possible to knit comfortably. The problem with this particular knitting aid is that the clamp must be loosened in order to release the needle each time all the stitches have been cast off, and then the clamp must be tightened onto the needle to which all the stitches have been transferred. It has to be appreciated that where the user is disabled in one hand, repeatedly tightening and loosening the clamp may become very tiring and may distress the user. The user may then require supervision and assistance, which takes away a lot of the enjoyment from the knitter and is undesirable from a therapeutic point of view.

Clamping a needle solidly in place does allow the individual to knit, provided the proper angle can be obtained. Each person requires the needle to be set at an angle specific to the individual needs of the person, which most clamping devices are unable to accommodate. Clamping does not allow for ease of changing from one needle to the other at the end of each knitted row. As well, clamping will not allow the stitches to be held in place without hindering the knitting process, and clamping reduces the number of stitches that can be placed on a knitting needle, because a portion of the knitting needle is taken up by the clamp.

Another known knitting aid comprises one or two resiliently biased stops, positioned between two opposing jaws so as to retain the needle in a channel formed by the two jaws. The resiliently biased stops permit the knitting needle to be moved without the necessity of loosening a clamp, but they do not act to tension the loops of yam on the needle, and this knitting aid does not permit the needle to be oriented at the user's optimum knitting position.

Therefore, there is a need in the art for a knitting aid which firmly secures a knitting needle while it is being worked from, and from which the needle can be easily removed when all the stitches have been cast off.

SUMMARY OF THE INVENTION

The present invention seeks to achieve these objectives by the provision of a knitting aid for use by individuals who have only the use of one functional hand and arm, thus enabling them to participate in the process of knitting with a pair of conventional knitting needles. In general terms, the invention is a knitting aid which includes a knitting needle holder having a magnetic field, created electrically or from a permanent magnet, to hold a knitting needle, plus means for tensioning yarn being knitted. Holding the knitting needle in this way also acts to secure the stitches in place on the needle, which helps in maintaining desired tension on the stitches as they are cast off the needle during the knitting process. By using a magnetic field to hold the needle and the stitches in place until needed, the stitches can be easily repositioned when required, by merely lifting the needle away from the magnetic source.

The knitting needle holder may be mounted on a pivoting head attached to a C-clamp, thus making it portable and permitting the knitting needle holder to be oriented in the position necessary for the proper execution of the knitting procedure.

When a knitting needle is positioned in the needle holder of the invention, it will become magnetically attractive, such that the needle tips will be attracted to each other. This can be an advantage in the knitting process for users with weak or unsteady hands. Instead of the user having to hold the needle tips together, the needles are automatically in that position and only need to be pulled apart to allow the movement of yarn between them. As with magnet therapy, the magnets used may have a therapeutic aspect: a North pole magnet is said to relieve aggravation from arthritis.

The knitting needle holder can be made of wood, plastic or any other suitable material capable of adequately supporting the source of the magnetic field. The yarn tensioning device may be made from any suitable material. In one embodiment, the yarn tensioning device contains material capable of being attracted by a magnet, and the yarn tensioning device is held in position by the magnetic field.

The knitting needles contain a substance capable of being attracted by a magnet, such as steel.

Accordingly, in one aspect the present invention is a knitting aid comprising a knitting needle holder including a source of magnetic field, wherein the magnetic field may be used to hold a knitting needle for knitting, plus a yarn tensioning device adjustably connectable to the knitting needle holder. In the preferred embodiment, the source of magnetic field is contained within a magnet housing, and the magnet housing defines a channel proximate to the source of magnetic field, such that a knitting needle may be positioned in the channel and will be held therein by the magnetic field. The source of magnetic field may be a permanent magnet; alternatively, it may be an electrical current or an electrical device.

In the preferred embodiment, the yarn tensioning device includes a member attached substantially perpendicularly to a plurality of proximate members through which yarn can be woven. Yarn traversing the proximate members in succession thus travels along a tortuous path with resulting friction and tension, thereby tensioning the yarn. The yarn tensioning device is adjustably connectable to the knitting needle holder, and preferably is shaped so as to be easy to use by people who may not have complete use of one hand, and such that it facilitates convenient use with either English or European knitting methods. In one embodiment, the yarn tensioning device contains material capable of being attracted by a magnet. As well, the invention may include a yarn tensioning device guide, adjustably mountable to the knitting needle holder, to assist in positioning the yarn tensioning device in a desired position relative to the knitting needle holder.

Also in the preferred embodiment, the knitting aid also includes a mounting attached to the knitting needle holder for securing it in a suitable location. Preferably, the mounting is adjustable such that the knitting needle holder may be roatated and tilted. In one embodiment, the mounting is a C-clamp attached to a fixable rotatable swivel which includes a fixable rotatable ball joint.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which preferred embodiments of the invention are illustrated and described.

DETAILED DESCRIPTION OF THE INVENTION

In the embodiment illustrated in FIGS. 1 to 4, the invention is a knitting aid (10) comprising a magnetic knitting needle holder (12) and a yarn tensioning device (16). In the preferred embodiment, the knitting aid (10) also comprises a mounting (14).

Figure 4:
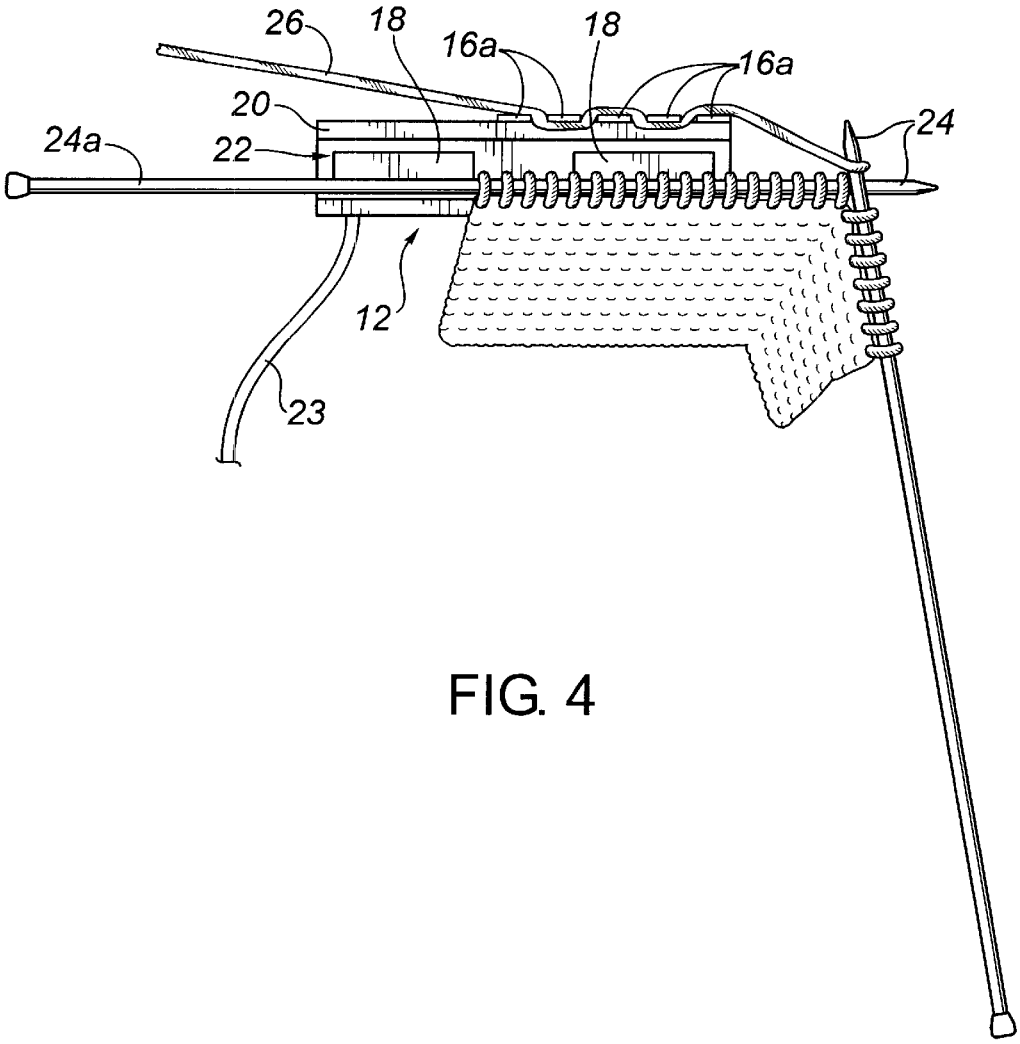
FIG. 4 is a top view of the magnetic knitting needle holder showing the magnetic knitting needle holder and yarn tensioning device in use.

In one embodiment, the magnetic knitting needle holder (12) comprises a magnet housing (20) having a channel (22) sufficiently large so as to contain a knitting needle (24) with loops of yarn (26). The magnet housing (20) may be made of any suitable material such as wood or plastic. The knitting needle (24) contains material capable of being attracted by a magnet, such as steel. Magnets (18) are fixed to the magnet housing (20) sufficiently proximate to the channel (22) so as to hold the knitting needle (24) in the channel (22). The magnets (18) may be permanent magnets or an electrical device which generates a magnetic field by means of a circulating electrical current provided by means of an electrical wire (23) as shown in FIG. 4. In one embodiment, shown in FIG. 2, the magnets (18) are embedded in the bottom of the channel (22).

The mounting (14) comprises a mounting device attached to a fixable rotatable swivel. The mounting device may be any suitable mounting device. In one embodiment, shown in FIG. 1, the mounting device is a C-clamp (28). In one embodiment, shown in FIG. 1, the fixable rotatable swivel comprises a ball joint (30) and a ball joint clamp (32). The ball joint (30) has a stem (34) which is connected to the knitting needle holder (12).

In one embodiment, the yarn tensioning device (16) is attached to the magnet housing (20). In a preferred embodiment, the yarn tensioning device (16) comprises a substantially rectangular plate having a plurality of notches (19) along one side, with a plurality of proximate members **(16*a*) defined by the notches (19). The yarn tensioning device (16) is attached to the magnet housing (20) in such a way that the position of the yarn tensioning device (16)** can be adjusted.

Figure 1:
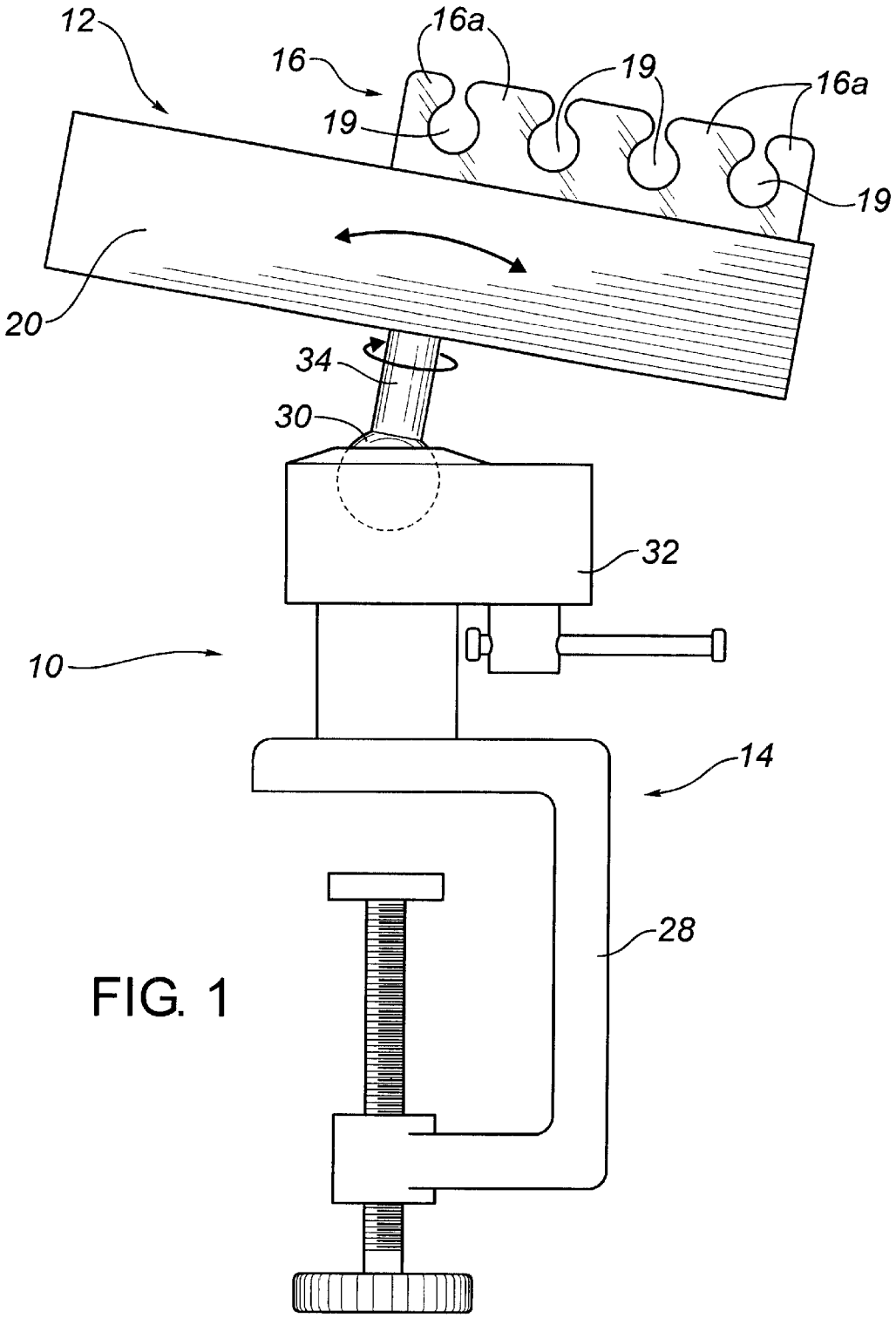
FIG. 1 is an elevation view of an embodiment of the knitting aid of the present invention, showing the magnetic knitting needle holder, mounting device, and yarn tensioning device.
Figure 2:
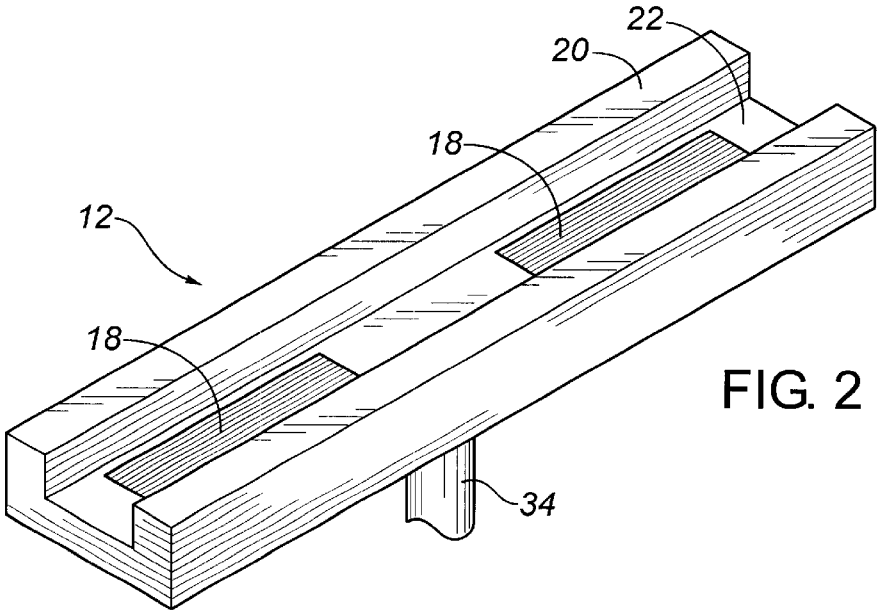
FIG. 2 is a perspective view of the magnetic knitting needle holder.
Figure 3:
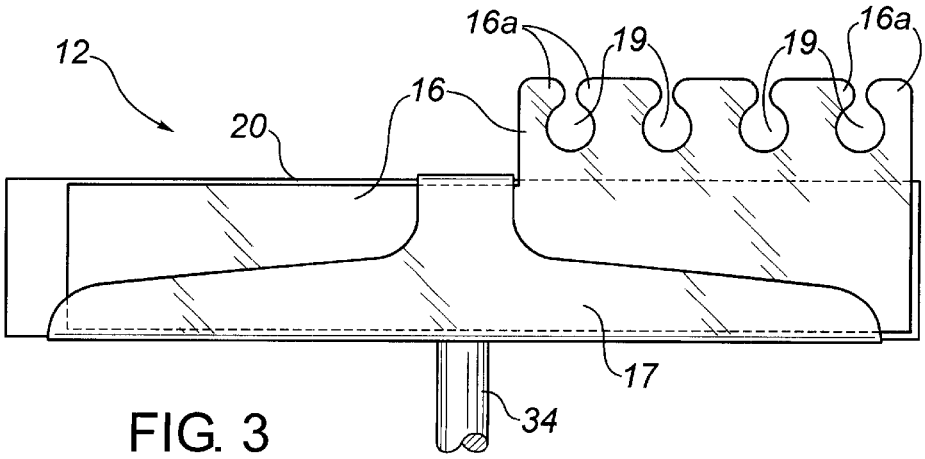
FIG. 3 is an elevation view of the back of the magnetic knitting needle holder showing the yarn tensioning device.

In one embodiment, shown in FIG. 3, the yarn tensioning device (16) contains material capable of being attracted by a magnet, and the invention also includes a yarn tensioning device guide (17). The yarn tensioning device (16) is positioned by the user between the yarn tensioning device guide (17) and the magnet housing (20). The magnetic force and the yarn tensioning device guide (17) act together to keep the yarn tensioning device (16) in the position selected by the user. The yarn tensioning device (16) can be positioned at either end of the magnet housing (20) depending on the needs of the user, including whether the user has use of the right or left hand.

As illustrated in FIG. 4, the knitting aid (10) is mounted in a suitable location with the C-clamp (28). Then a knitting needle (24) is placed in the channel (22) and the magnet housing (20) is rotated and tilted until a satisfactory knitting position is discovered. The magnet housing (20) is locked in position with the ball joint clamp (32). Yarn (26) is woven through the notches (19) (FIG. 4) until sufficient tension is achieved. Then the user may begin knitting.

Knitting involves repeatedly looping yarn (26) around knitting needles (24). At any time during the knitting process, one or both of the knitting needles (24) will have a plurality of loops of yarn (26) around it. For greater clarity, the knitting needle held in the channel (22) of the knitting needle holder (12) may be referred to as the stationary needle **(24*a*). If the stationary needle (24*a*) is the knitting needle receiving loops of yarn (26) during the knitting process, then the stationary needle 24*a* may be lifted from the channel (22) to slide the loops of yarn (26) onto the stationary needle 24*a*. If the stationary needle (24*a*) is the knitting needle from which loops of yarn (26) are being removed during the knitting process, then the loops of yarn (26) may be slid from between the stationary needle (24*a*) and the magnet housing (20), and the attractive force between the magnets (18) and the stationary needle (24*a*) is sufficient to properly tension the loops of yarn (26) as they are drawn from the stationary needle (24*a*)**.

The foregoing is a description of a preferred embodiment of the invention which is given here by way of example. The invention is not to be taken as limited to any of the specific features as described, but comprehends all such variations thereof as come within the scope of the appended claims.

What is claimed is:

1. A knitting aid comprising:

(a) a knitting needle holder including a source of magnetic field, wherein the magnetic field may be used to hold a knitting needle for knitting; and (b) a yarn tensioning device adjustably connectable to the knitting needle holder.

2. The knitting aid of claim 1, further comprising a magnet housing, wherein the source of the magnetic field is contained within said housing.

3. The knitting aid of claim 2, wherein the magnet housing defines a channel proximate to the source of magnetic field.

4. The knitting aid of claim 1, wherein the source of magnetic field is a permanent magnet.

5. The knitting aid of claim 1, wherein the source of magnetic field comprises an electric current.

6. The knitting aid of claim 1, wherein the yarn tensioning device comprises a member attached substantially perpendicularly to a plurality of proximate members through which yarn can be woven, whereby yarn traversing the proximate members in succession flows along a tortuous path with resulting friction and tension.

7. The knitting aid of claim 6, wherein the yarn tensioning device contains material capable of being attracted by a magnet.

8. The knitting aid of claim 6, further comprising a yarn tensioning device guide, adjustably mountable to the knitting needle holder, for positioning the yarn tensioning device in a desired position relative to the knitting needle holder.

9. A knitting aid comprising:

(a) a knitting needle holder including a source of magnetic field, wherein the magnetic field may be used to hold a knitting needle for knitting;

(b) a yarn tensioning device adjustably attachable to the knitting needle holder; and (c) a mounting attached to the knitting needle holder for securing it in a suitable location.

10. The knitting aid of claim 9, wherein the mounting is adjustable such that the knitting needle holder may be tilted.

11. The knitting aid of claim 9, wherein the mounting is adjustable such that the knitting needle holder may be rotated.

12. The knitting aid of claim 9, wherein the mounting comprises a C-clamp attached to a fixable rotatable swivel.

13. The knitting aid of claim 12, wherein the fixable rotatable swivel comprises a fixable rotatable ball joint.

14. A knitting aid comprising:

(a) a knitting needle holder including a source of magnetic field wherein the magnetic field may be used to hold a knitting needle for knitting;

(b) a magnet housing associated with the knitting needle, said magnet housing defining a channel and said source of magnetic field being contained within the magnet housing;

(c) a yarn tensioning device connected to the knitting needle holder, said yarn tensioning device comprising a member attached substantially perpendicularly to a plurality of proximate members through which yarn can be woven, whereby yarn traversing the proximate members in succession flows along a tortuous path with resulting friction and tension; and (d) a mounting attached to the knitting needle holder for securing it in a suitable location, said mounting comprising a C-clamp attached to a fixable rotatable swivel.

15. The knitting aid of claim 14, wherein the source of magnetic field is a permanent magnet.

16. The knitting aid of claim 14, wherein the source of magnetic field comprises an electric current.

17. The knitting aid of claim 14, wherein the yarn tensioning device contains material capable of being attracted by a magnet.

18. The knitting aid of claim 14, further comprising a yarn tensioning device guide, adjustably mountable to the knitting needle holder, for positioning the yarn tensioning device in a desired position relative to the knitting needle holder.

* * * * *